United States Patent [19]

Suckow

[11] Patent Number: 4,520,607

[45] Date of Patent: Jun. 4, 1985

[54] RELEASABLE RESILIENT MOUNTING ASSEMBLY FOR PANEL MEMBERS

[75] Inventor: Klaus Suckow, Biebesheim, Fed. Rep. of Germany

[73] Assignee: Stahlkonstruktionen Suckow & Fischer, Biebeshiem, Fed. Rep. of Germany

[21] Appl. No.: 495,787

[22] Filed: May 18, 1983

[30] Foreign Application Priority Data

May 27, 1982 [DE] Fed. Rep. of Germany ..... 3219933

[51] Int. Cl.[3] ..... E04B 5/52

[52] U.S. Cl. ..... 52/489; 52/484; 24/543; 24/336

[58] Field of Search ..... 52/489, 484, 712, 769, 52/773, 774, 764; 24/543, 336

[56] References Cited

U.S. PATENT DOCUMENTS 3,720,432 3/1973 Chudler ..... 52/484 X 3,934,387 1/1976 Moeller ..... 52/489

FOREIGN PATENT DOCUMENTS 616991 2/1961 Italy ..... 52/489

*Primary Examiner*—Donald G. Kelly

*Assistant Examiner*—Naoko N. Slack

*Attorney, Agent, or Firm*—Toren, McGeady, Stanger

[57] ABSTRACT

A retaining clip composed of a resilient clasping spring and a lock member wherein the clasping spring operates to releasably engage the engagement portion of a panel member, such as a wall or ceiling plate, the engagement portion operating to resiliently displace the clasping spring when the panel member is brought into supported engagement therewith and to further resiliently displace the clasping spring so that it may be brought into engagement with the lock member to hold the clasping spring in a disengaged position to allow the panel member to be released, the clasping spring being adapted to be brought back to its original position when a panel member is to be again brought into supported engagement therewith.

20 Claims, 16 Drawing Figures

Fig.1
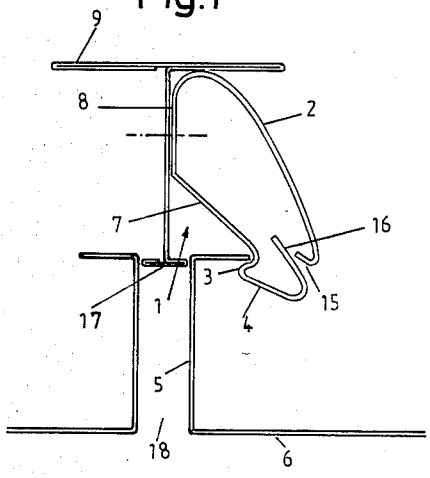
Fig.2
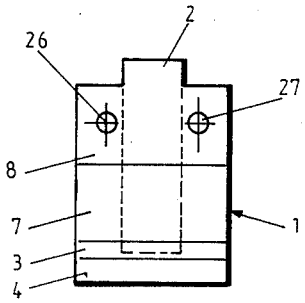
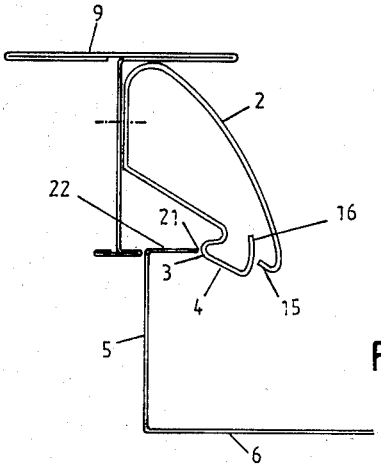
Fig.3
Fig.4
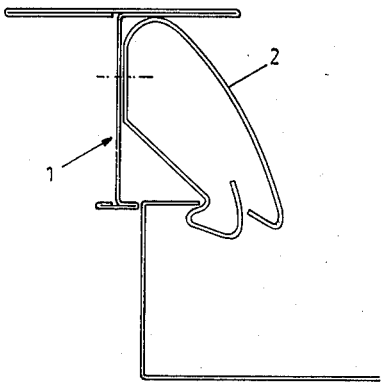
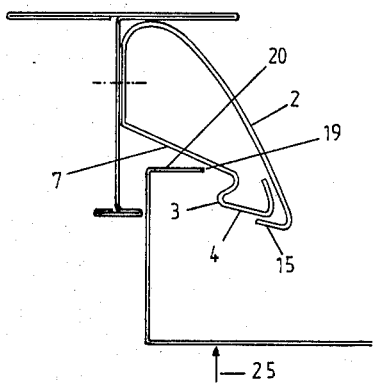
Fig.5

RELEASABLE RESILIENT MOUNTING ASSEMBLY FOR PANEL MEMBERS

The invention relates to mounting assemblies for panel members such as wall panels or ceiling plates and more particularly to a resilient retaining mechanism for engaging an angled border of such plates or panels.

In the prior art, it is known to support panels or plates of the type mentioned above by utilizing a frame construction which is generally composed of longitudinal and transverse rails or bars which are mounted to intersect one another and which may, for example, be suspended from a ceiling to hold or support ceiling panels or tiles. The panels or cover plates are inserted in the intermediate spaces between the intersecting bars or rails and usually flanges are provided on the rails to support or engage the panels.

Another manner for supporting such panels or plates is to employ clamps or clamping profile bars. Such an approach is particularly appropriate if the panels or plates are produced from sheet metal and are provided with angled borders. When the panels are attached at the wall or ceiling structure, the angled borders of the plates will catch or engage in the clamps or clamping profiled bars of the support assembly thereby enabling quick and easy mounting of the structure.

However, in such prior art devices difficulties can arise if the individual panels or plates must be temporarily removed, for example when it is necessary to obtain access to installation systems such as electrical lines, water lines, ventilation systems and the like covered by the panels or plates. If the covering panels are supported upon a carrying frame, then they must be lifted and removed thereby requiring considerable free space above the plates or panels if the panels are used as a ceiling cover. As a result, a certain minimum distance must be provided between the panel or plate and the support structure upon which it is mounted, including for example any installation systems which may be covered by the panels. If the cover panels or plates are fastened with clamps or clamping profile bars, then it may be necessary to remove entire rows of the panels in order to obtain access to a desired panel since the clamps or clamping profile bars, respectively, are only accessible from the rear side of the plates or panels and may only be detached with special tools.

It will be evident that such procedures will involve substantial time to perform and will likewise involve a requirement for free space to be available to enable operations to be performed above or behind the panels or plates.

Accordingly, the present invention is directed toward provision of a mounting assembly for panel members or plates such as cover plates or wall panels, which will enable removal of the panels downwardly or outwardly away from a support structure in order to enable the free space which is required above or behind the panels to be maintained at a minimum without interfering with assembly or disassembly of the panels with the mounting structure.

SUMMARY OF THE INVENTION

Briefly, the present invention may be described as a mounting assembly for releasably supporting a panel member comprising a stationary support member to which said panel member is to be attached, retaining clip means affixed to said support member adapted to releasably hold in place said panel member, said retaining clip means comprising clasping spring means resiliently movable between an engaging position at which said panel member is releasably engaged therewith and a disengaged position for release of said panel member and a lock member adapted to engage said clasping spring means to hold said clasping spring means in said disengaged position during removal or disengagement of said wall member therefrom and to release said clasping spring means prior to or during replacement of said wall member to enable said clasping spring means to return to said engaging position.

Thus, the invention is capable of operating in an advantageous manner in that the clasping spring means may be formed with a catch or detent adapted to engage therewith in holding engagement an angled border of the panel member which may engage with the clasping spring means with the lock member securing the clasping spring means in the unlocking or disengaged position when the panel member is to be removed, the lock member releasing the clasping spring means before or during replacement of the panel member.

The mounting assembly of the invention provides an advantage in that individual panel members may be removed from a supporting structure without requiring laborious operations when repair work must be carried out on installation systems covered by the panel member. No special tools are required for removal and replacement of the panel members and other panel members or plates need not be displaced in order to provide access to a particular panel member. As a result of the system of the invention, it is not necessary to provide excessive open space above or behind the panel members which are to be supported in order to then permit removal or replacement of the panel members since a slight pressing and lifting of the panel members will be sufficient to unlock the clasping spring means and to engage the clasping spring means with the lock member to hold the clasping spring means in the releasing position enabling the panel member to be disengaged therefrom.

In accordance with an advantageous further aspect of the invention, the clasping spring means is provided with slanted surface means which may be engaged by an angle piece of the panel member or cover plate in order to resiliently move the catch spring means to enable the engagement thereof with the angle piece and also to enable the clasping spring means to be moved out of the engaged position into locking engagement with the lock member merely by an inward pressing of the panel member. As a result of the construction of the present invention, the clasping spring means provides a simple attachment mechanism which may be affixed to a supporting structure and which will readily operate to permit easy attachment and detachment of the panels. The lock member may be composed of a retaining spring member which is formed integral with the clasping spring means and which may engage with part of the clasping spring means to secure the clasping spring means in the disengaged position. A secure snapping-in of the clasping spring means with the lock member is ensured if an opening within which the lock member or retaining spring may be engaged is provided in the clasping spring means behind the part thereof which engages the panel member.

The clasping spring means may also be constructed with a V-shaped configuration wherein a side or leg of the clasping spring means may be formed with a catch nose at its free end for engagement with an angle piece of the panel member or cover plate with the other side having a laterally angled spring tongue as a lock for the clasping spring means in its unlocking position.

The structure of individual clasping spring members may be adapted to respective requirements and they may be fastened either adjacent to one another or in pairs at the supporting structure or at a turning clip that is attachable on the supporting structure.

It is also possible to combine two clasping springs into a structural unit which may be mounted by sliding engagement into a profiled bar and held in position thereat.

Spring elements which are arranged perpendicularly relative to a fastening surface of the clasping spring can be attached thereat and may engage in openings of a support carrier which may be in the form of a T-profiled bar. Moreover, it is possible to attach a joining piece with the spring tongues at the fastening surface of the clasping spring for clipping on of the profiled bars.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE DRAWINGS

In the drawings

FIG. 1 is a schematic side view of a mounting assembly in accordance with the invention;

FIG. 2 is a plan view of the clasping spring shown in FIG. 1;

FIGS. 3, 4, and 5 are schematic side views of the device shown in FIG. 1 depicting insertion and removal of a panel member;

DETAILED DESCRIPTION OF THE PREFERRED EMBODIMENTS

Figure 6:
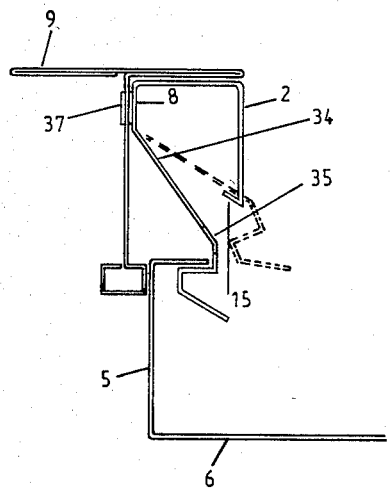
FIGS. 6, 7, and 8 are, respectively, a side view, a plan view, and a top view of a second embodiment of the invention.

Referring now to the drawings, and particularly to FIGS. 1–5 wherein there is depicted a first embodiment of the invention, the mounting assembly of the present invention is shown as comprising a retaining clip 1 which is essentially produced from a stamped metal part integrally formed to include clasping spring means composed of a clasping side 7 having a clasping nose 3 defined at one end thereof and a lock member 2 having a lock hook 15 defined at one end thereof. The retaining clip 1 is angled in such a manner that the clasping nose 3 extends contiguously with a sliding surface 4 which is adapted to be engaged by an L-shaped angle piece 5 of a cover plate or panel member 6 which is to be mounted or connected by the retaining clip 1.

The retaining clip 1 also includes a fastening wall 8 whereby the clip 1 may be affixed or fastened to a T-shaped profile bar 9 which, for example, may be affixed as part of a support structure or which may be fastened to a wall structure upon which the panel member 6 is to be mounted.

The lock member 2 is constructed with the lock hook 15 in a manner to enable the lock hook 15 to cooperate with a sliding surface 16 formed on the retaining clip 1 as part of the clasping spring means.

The T-bar 9 has a lower flange member 17 which serves as a counter bearing member for the retaining clip 1 and also as a distancing piece for retaining a joint 18 between a pair of rows of panel members 6. The fastening wall 8 of the retaining clip 1 is formed with a pair of holes 26 and 27 through which fastening rivets may be inserted for affixing the retaining clip 1 to the T-bar 9.

When a panel member is to be mounted in supported engagement with the mounting assembly of the invention, the angle piece 5 is moved so that the end or tip thereof will abut against the sliding surface 4 which, due to its inclined or sloped configuration, will cause the clasping spring including the clasping side 7 and the clasping nose 3 to be resiliently moved to one side so that the angle piece 5 may be inserted into locked engagement with the clasping spring member 7, 3, 4. The manner in which this action occurs is best seen in FIG. 3. It will be seen that the angle piece 5 is formed with an edge 21 and an angled portion 22. As the edge 21 is pressed against the surface 4, the clasping spring member moves to the right thereby enabling the edge 21 to be brought behind the nose 3. This position of the angle piece 5 is shown in FIG. 4. As soon as the edge 21 of the angled portion 22 has passed over the nose 3, the clasping spring member catches and holds the angle piece 5 and, accordingly, the panel 6 will thereby be held in a secure supported manner as shown in FIG. 4. During this operation, the lock hook 15 will slide along a sliding surface 16 defined on the end or edge of the clasping spring member.

If it is desired to remove the panel member 6 from its supported engagement with the mounting assembly, this may be accomplished by pushing the panel member 6 inwardly as indicated by the arrow 25 in FIG. 5. As a result of this inward movement of the panel member 6, the edge 21 of the angle piece 5 will abut against the clasping side 7 which is also arranged with a slanted configuration and this will cause the clasping spring member including the nose 3 and the side 7 to be further resiliently moved until the hook 15 slides over the sliding surface 16 to engage the nose portion of the clasping spring member defined between the sliding surface 4 and the sliding surface 16. When the hook 15 has reached the sliding surface 4 and has been brought into engagement about the end of the clamping spring member as shown in FIG. 5, the clamping spring member will be locked in its open position as shown in FIG. 5 so that the panel member 6 may then be moved outwardly in a direction opposite to the arrow 25 so that it may be disengaged from the mounting assembly.

After the panel member 6 has been disengaged, the lock member 2 may be manually disengaged from the clasping spring by releasing the end 4, 16 of the clasping spring from the hook 15 whereby the clasping spring member will return to its initial position shown in FIG. 1 ready to enable insertion of a new panel member into engagement therewith.

Thus, it will be seen that with the present invention, the panel member 6 may be brought into mounting engagement with the mounting assembly first merely by pushing the panel member inwardly so that it may become engaged in the manner described in connection with FIGS. 3 and 4 with removal of the panel member being readily accomplished merely be again pushing the panel member further inwardly to effect locking engagement of the clamping spring with the locking member 2 as shown in FIG. 5 so that the panel member may be released.

Figure 7:
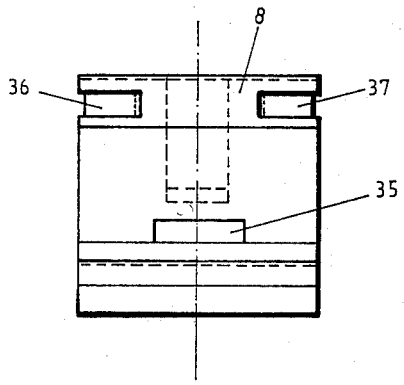
Figure 8:
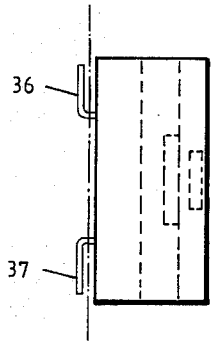

A second embodiment of the invention is depicted in FIGS. 6–8, and this embodiment differs from the embodiment shown in FIGS. 1–5 insofar as a different structure is provided for engaging the lock member with the clamping spring member. In the embodiment of FIGS. 6–8, the hook 15 is arranged to slide along a spring arm 34 of the clasping spring means when the panel 6 is to be released from mounted engagement. It will be seen that, with particular reference to FIG. 6, if the panel member 5 is pressed inwardly, the spring arm 34 will move from the solid line position shown in FIG. 6 to the dotted position and, as a result, the hook 15 will slide along the arm 34 until it catches into a slot 35 formed in the arm 34. As a result, the hook 15 will lock the clasping spring means in the open position shown in dashed form in FIG. 6 and the panel member 6 may then be removed.

The assembly of the embodiment of FIGS. 6–8 is provided with attachment tabs 36 and 37 which are provided at the fastening surface 8, these tabs being inserted and bent to connect the retaining clip with the T-bar 9 by placing the tabs 36 and 37 through openings in order thereby to affix the retaining clip in place.

Figure 9:
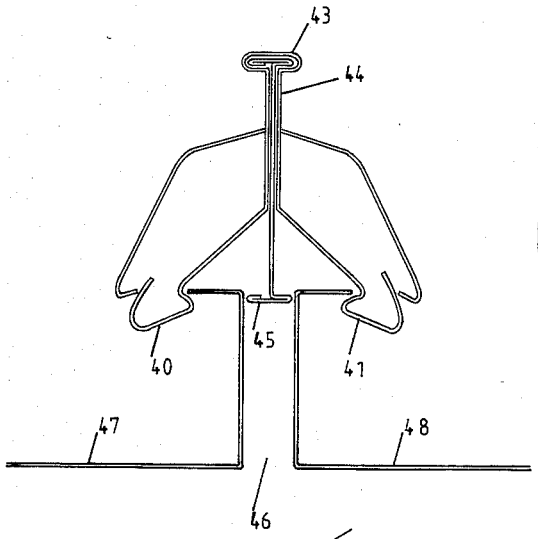
FIG. 9 is a schematic side view showing an arrangement utilizing a pair of retaining clips in accordance with the invention arranged adjacent each other on a profiled bar.

In FIG. 9 there is shown an arrangement wherein a pair of retaining clips 40 and 41 are fastened with a T-bar 43 and are combined into a structural unit by means of a common web 44, this structural unit being arranged to be moved into sliding engagement onto the T-bar 43. A lower flange 45 of the T-bar 43 provides a joint 46 between a pair of panels 47 and 48 which border with one another and which are shown in mounted engagement in FIG. 9.

Figure 10:
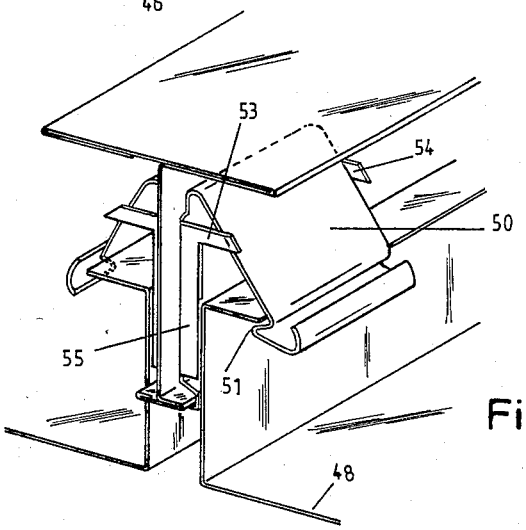
FIG. 10 is a perspective view showing a third embodiment of the invention.
Figure 11:
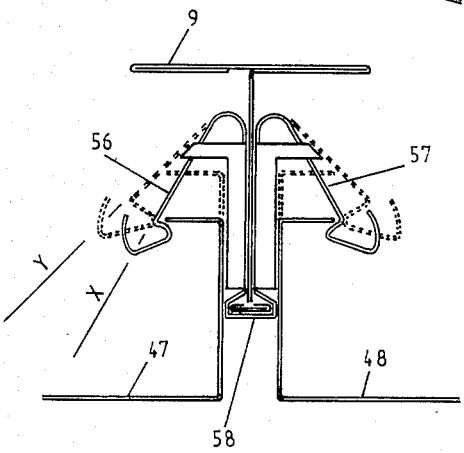
FIG. 11 is a side view of the embodiment shown in FIG. 10.

FIGS. 10 and 11 show another embodiment of the invention comprised of a pair of V-shaped retaining clips 56 and 57. The retaining clips 56, 57 are formed with a clasping nose 51 which is arranged on the free end of a side 50 forming together therewith the clasping spring means of the invention. Provided at the inner sides of the retaining clips 56, 57 are laterally angled spring tongues 53 and 54 located on the inner side of the wall 50. With the panel members 47 and 48 in the supported position shown in FIGS. 10 and 11, the wall 50 will be located between the sides of the spring tongues 53 and 54. However, when the panels 47 and 48 are moved inwardly in the manner previously described in order to engage on the inner surfaces of the sides 50, the clasping spring means will be raised or outwardly resiliently extended in the manner shown in dashed form in FIG. 11 and the two spring tongues 53 and 54 will become engaged behind the walls 50 thereby to retain the clasping spring means in the disengaged position shown in dashed form in FIG. 11 to enable the panels 47 and 48 to be removed.

The two spring tongues 53 and 54 are formed with downward extensions 55 which operate to form distancing pieces between the two adjoining panels 47 and 48. The two V-shaped retaining clips 56 and 57 shown in accordance with FIG. 11 which are combined into a structural unit have a shared web 58 which may slide along the T-bar 9 so that the two clips 56 and 57 will fit securely onto the T-bar 9.

Figure 12:
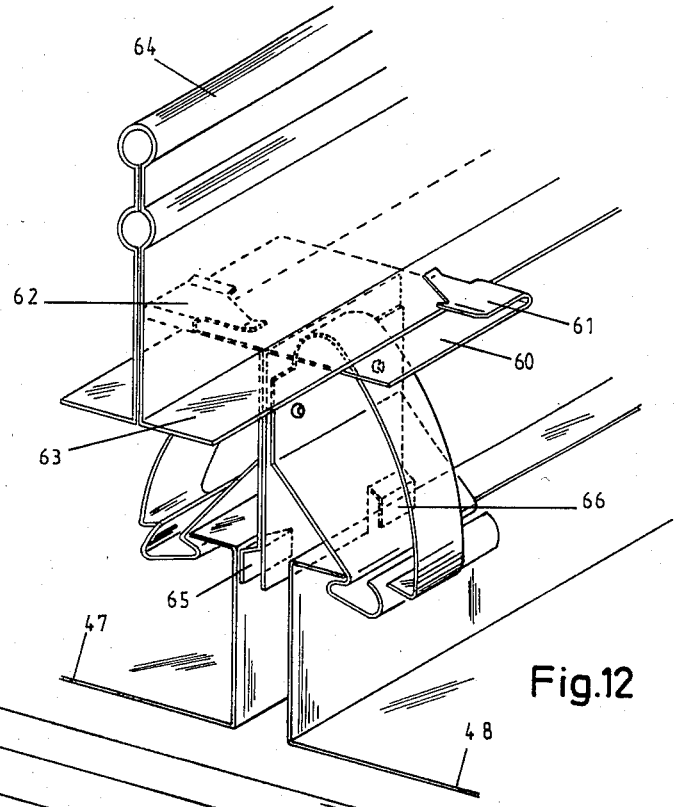
FIG. 12 is a perspective view showing a pair of retaining clips of the type shown in FIG. 1 and depicting the mounting arrangement thereof.
Figure 13:
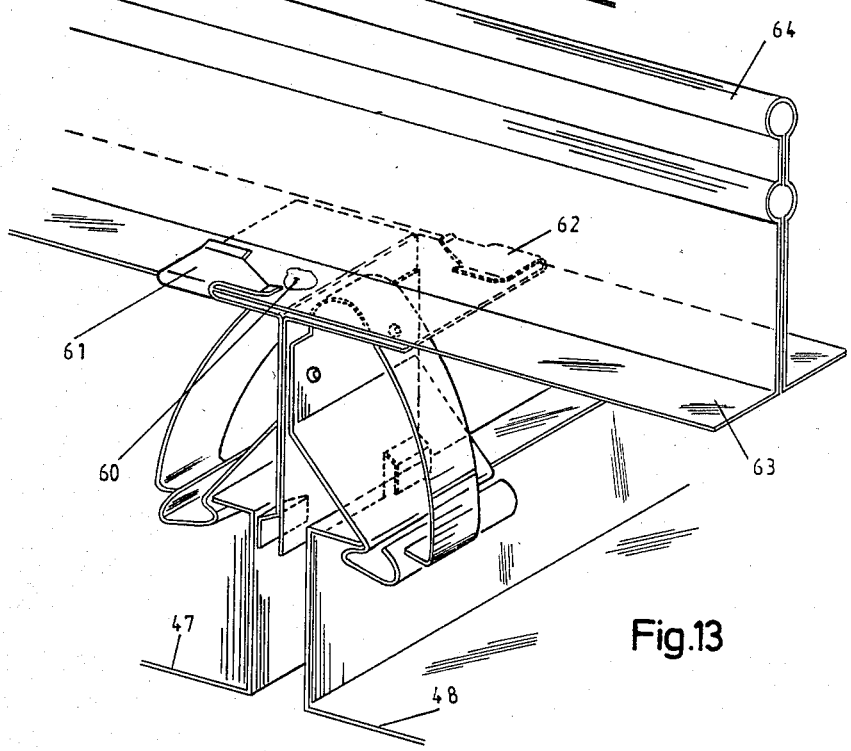
FIG. 13 is a perspective view showing an alternative arrangement similar to that depicted in FIG. 12.

FIGS. 12 and 13 show two alternative mounting arrangements for the mounting assembly of the invention. As will be seen in FIGS. 12 and 13, the mounting assembly of the invention is attached to a T-bar 64 so as to connect therewith a pair of panels 47 and 48. In FIG. 12, the panels 47 and 48 extend longitudinally parallel to the T-bar 64 and in FIG. 13, the panels 47 and 48 extend longitudinally perpendicularly to the T-bar 64. The resilient retaining clips shown in FIGS. 12 and 13 are similar to those shown in FIG. 1, and they are fastened at turning clips 60 which have stamped clamping tongues 61 and 62. These tongues allow the turning clip 60 to be fastened in the transverse direction on a double flange 63 of the T-bar 64, as shown in FIG. 12. The tongues also allow the turning clip 60 to be connected in a transverse direction onto the double flange 63 of the T-bar 64, as shown in FIG. 13. Such turning clips may thus be attached at longitudinal or transverse bars so that the separating joint between the panels may extend either parallel to the support bar 64 or perpendicularly thereto. Brackets or clips 65 and 66, which are stamped out of the turning clip 60, serve as distancing pieces for the panels 47 and 48.

Figure 14:
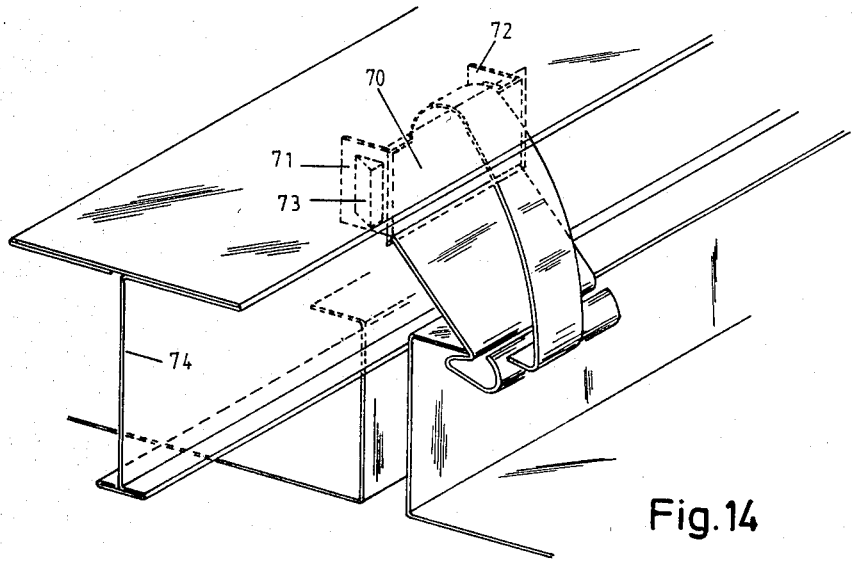
FIG. 14 is a perspective view depicting a fourth embodiment of the invention.
Figure 15:
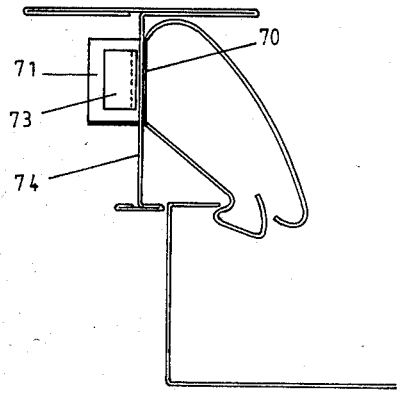
FIG. 15 is a side view of the embodiment shown in FIG. 14.

A fourth embodiment of the invention is shown in FIGS. 14 and 15. In this embodiment, the retaining clip of the invention is provided with two lateral angled portions 71 and 72 located at a fastening surface 70 provided with spring tongues 73 which enable a secure clamping of the retaining clip in an opening of a web 74 of a T-bar. Thus, by inserting the angle portions 71 and 72 through the opening in the web 74, the springs 73 will be resiliently moved toward each other and then be allowed to engage behind the wall of the web 74 to hold the retaining clip in place.

Figure 16:
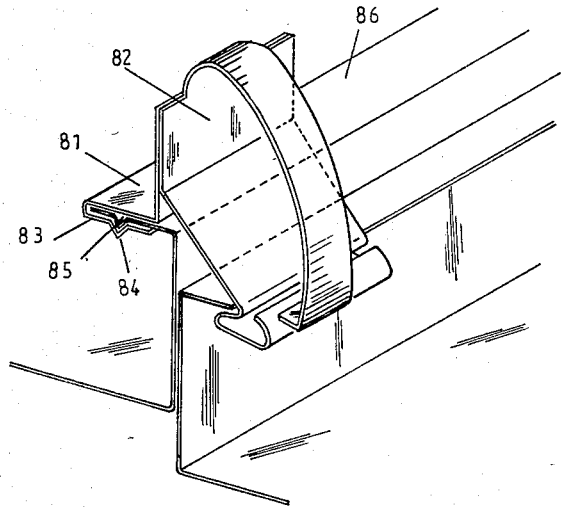
FIG. 16 is a perspective view depicting a fifth embodiment of the invention.

A fifth embodiment of the invention is shown in FIG. 16, and in this embodiment the retaining clip is formed with an L-shaped joining piece 81 provided at a fastening surface 82 to enable fastening of the retaining clip onto a U-shaped profile bar 80. It will be seen that by slipping the upper edge of the profile bar 80 between the walls of the joining piece 81, the retaining clip may be mounted in position on the bar 80. The joining piece 81 is bent in such a way that a spring tongue 83 is formed which has a notch 84. The notch 84 cooperates with a notch 85 in an angled border 86 of the U-bar 80 thus preventing the L-shaped joining piece 81 from becoming detached off the border 86.

As will be seen from the foregoing, the present invention will provide a mounting assembly enabling wall plates or panel members, particularly panel members made of sheet steel, to be securely mounted on support members such as clamping profile bars. The holding mechanism of the invention makes it possible to remove the panel members downwardly or forwardly, depending upon the type of structure involved, in order to maintain to a minimum the free space which is required between the base or support structure and the panel member to be attached thereto, which space is required to enable assembly or disassembly of the panel member from the support structure. This is achieved by the present invention in that the mounting assembly is composed of a resilient clip member comprising clasping spring means having a clasping nose engaging with an angle part of the panel member and with a lock member which secures the clasping spring member in its unlocking position when the panel member is to be removed. The clasping spring member is easily unlocked from the lock member before or during replacement of the panel member. Thus, individual panel members may be removed from a wall or ceiling cover or sheathing without great expenditure of labor and the panel members may be again inserted in place if repair work must be effected at installation systems covered by the panels.

While specific embodiments of the invention have been shown and described in detail to illustrate the application of the inventive principles, it will be understood that the invention may be embodied otherwise without departing from such principles.

What is claimed is:

1. A mounting assembly for releasably supporting a panel member comprising:

a stationary support member to which said panel member is to be attached;

retaining clip means affixed to said support member adapted to releasably hold in place said panel member;

said retaining clip means comprising clasping spring means resiliently movable between an engaging position at which said panel member is releasably engaged therewith and a disengaged position for release of said panel member and a lock member adapted to engage said clasping spring means to hold said clasping spring means in said disengaged position during removal of said panel member and to release said clasping spring means prior to or during replacement of said panel member.

2. An assembly according to claim 1 wherein said retaining clip means is formed as a unitary member comprising said clasping spring means and said lock member, wherein said clasping spring means is formed with a wall angled in such a manner that it provides a sliding surface to be engaged by said panel member, said panel member being formed with an angle piece which is adapted to abut against and engage said sliding surface, said clasping spring means further providing a catch nose which is adapted to engage behind said angle piece of said panel member and a second sliding surface which is also adapted to be engaged by said angle piece when said panel member is moved into supported engagement with said mounting assembly.

3. An assembly according to claim 2 wherein said retaining clip means further comprises a fastening surface for attachment of said retaining clip means on said stationary support member.

4. An assembly according to claim 2 wherein said lock member is composed of a retaining spring member arranged relative to said clasping spring means to cooperate with a third sliding surface formed on said clasping spring means to engage said clasping spring means and lock said clasping spring means in said disengaged position.

5. An assembly according to claim 1 wherein said clasping spring means is formed with a slot and wherein said lock member is adapted to engaged within said slot to releasably hold said clasping spring means in said disengaged position.

6. An assembly according to claim 1 wherein said retaining clip means is formed with a generally V-shaped configuration having on one side thereof a catch nose for engaging with a part of said panel member to hold said panel member with the other side of said V-shaped configuration being formed with laterally angled spring tongues adapted to engage behind said one side of said V-shaped configuration to hold said one side in a position disengaged from said part of said panel member.

7. An assembly according to claim 1 wherein a pair of retaining clip means are fastened adjacent one another on a common stationary support member.

8. An assembly according to claim 1 further comprising holder means for fastening said retaining clip means onto said stationary support member.

9. An assembly according to claim 8 wherein said holder means comprise turning clips which are adapted to enable said retaining clip means to be attached in pairs to said stationary support member in either of two orientations to enable the relative positioning of said panel member to said stationary support member to be changed through an angle of 90°.

10. An assembly according to claim 1 wherein said stationary support member comprises a profiled bar and wherein said retaining clip means comprise a pair of retaining clips which are combined into a structural unit which can be slidably mounted onto said profiled bar.

11. An assembly according to claim 10 wherein said pair of retaining clips are connected with one another to form an attachable double retaining spring clip by means of a connecting web adapted to said profiled bar.

12. An assembly according to claim 10 wherein said pair of retaining clips are formed with a V-shaped configuration each having a straight side, said retaining clips being connected with each other at said straight sides by means of a connecting web adapted to said profiled bar to form an attachable double retaining clip.

13. An assembly according to claim 1 wherein said retaining clip means comprise resilient detent means and wherein said stationary support member comprises an opening adapted to have engaged therethrough said resilient detent means to enable said retaining clip means to be mounted onto said stationary support member.

14. An assembly according to claim 13 wherein said stationary support member comprises a fastening surface having said opening therein and wherein said resilient detent means comprise spring elements arranged perpendicular relative to said fastening surface.

15. An assembly according to claim 13 wherein said resilient detent means are composed of a pair of lateral angled portions having stamped-in spring tongues.

16. An assembly according to claim 1 wherein said stationary support member comprises a generally planar attachment flange and wherein said retaining clip means comprise a generally U-shaped connecting profile adapted to be slidably fitted over said planar attachment flange to mount said retaining clip means onto said stationary support member.

17. An assembly according to claim 16 wherein said planar attachment flange and said U-shaped connecting profile are each formed with complementary detent means to retain said members attached to each other.

18. A mounting assembly for releasably supporting a panel member comprising:

a stationary support member to which said panel member is to be attached;

retaining clip means affixed to said support member adapted to releasably hold in place said panel member;

said retaining clip means comprising clasping spring means resiliently movable between an engaging position at which said panel member is releasably engaged therewith and a disengaged position for release of said panel member and a lock member adapted to engage said clasping spring means to hold said clasping spring means in said disengaged position, said lock member being adapted to be manually actuated to release said clasping spring means to allow said clasping spring means to resiliently return to said engaging position; and engagement means on said panel member adapted to be engaged by said clasping spring means to hold said panel member in supported engagement, said engagement means being configured to resiliently displace said clasping spring means by abutting contact therewith to enable said engagement means to be brought into said supported engagement and to further resiliently displace said clasping spring means by abutting contact therewith to resiliently bring said clasping spring means into engagement with said lock member to enable release of said panel member from said supported engagement.

19. An assembly according to claim 18 wherein said engagement means comprise a generally L-shaped angle piece and wherein said retaining clip means comprise a nose portion adapted to engage behind said angle piece, said angle piece operating to engage said clasping spring means to resiliently move said clasping spring means to enable said angle piece to be brought into engaged position behind said nose portion.

20. An assembly according to claim 19 wherein said angle piece is adapted to move said clasping spring means into locked engagement with said lock member while said angle piece is engaged behind said nose portion by pressed movement of said panel member inwardly of said retaining clip means while said angle piece is engaged behind said nose portion.

* * * * *